US006198363B1

(12) United States Patent
Vuoppola et al.

(10) Patent No.: US 6,198,363 B1
(45) Date of Patent: Mar. 6, 2001

(54) FILTER AND TUNING ELEMENT

(75) Inventors: Esa Vuoppola; Anssi Kotanen; Pauli Juntunen; Mika Henriksson, all of Oulu (FI)

(73) Assignee: ADC Telecommunications OY, Oulu (FI)

( * ) Notice: Subject to any disclaimer, the term of this patent is extended or adjusted under 35 U.S.C. 154(b) by 0 days.

(21) Appl. No.: 09/211,260

(22) Filed: Dec. 14, 1998

(30) Foreign Application Priority Data

Dec. 15, 1997 (FI) ..... 974517

(51) Int. Cl.[7] ..... H01P 1/20; H01P 7/04

(52) U.S. Cl. ..... 333/202; 333/203; 333/207; 333/223

(58) Field of Search ..... 333/202, 203, 333/206, 207, 222, 223

(56) References Cited

U.S. PATENT DOCUMENTS

| | | | | |
|---|---|---|---|---|
| 3,020,500 | | 2/1962 | Beiser | 333/82 |
| 4,423,398 | * | 12/1983 | Jachowski et al. | 333/233 |
| 5,550,519 | * | 8/1996 | Korpela | 333/207 |
| 5,666,093 | * | 9/1997 | D'Ostillio | 333/207 |

FOREIGN PATENT DOCUMENTS

| | | |
|---|---|---|
| 532864 | 2/1973 | (CH) . |
| 1918356 | 10/1970 | (DE) . |
| 1766243 | 7/1971 | (DE) . |

* cited by examiner

*Primary Examiner*—Robert Pascal
*Assistant Examiner*—Patricia T. Nguyen
(74) *Attorney, Agent, or Firm*—Ladas & Parry

(57) ABSTRACT

The invention relates to a filter and a frequency tuning element. The filter comprises a shell construction (2*a* to 2*d*) of conductive material with at least one section (14 to 16) and in the shell construction (2*a* to 2*d*) at least one resonator (17 to 19) of conductive material in said at least one section (14 to 16) for forming at least one resonance circuit (11 to 13). In the filter (1) the resonator (18) comprises as its extreme ends a base (18*a*) and a second end (18*b*), in said filter (1) the base (18*a*) of the resonator (18) being fastened to the shell construction (2*a* to 2*d*) and the second end (18*b*) of the resonator (18) being directed elsewhere towards the shell construction (2*a* to 2*d*) at a distance therefrom, the resonator (18) comprising a means (32) which directs its surface towards the shell construction (2*a* to 2*d*) and increases the cross-sectional area of the resonator to increase the capacitance between the resonator (18) and the shell construction (2*a* to 2*d*). The filter (1) further comprises a frequency tuning element (42) of conductive material for tuning the resonance frequency of the resonator (18) of the resonance circuit (12). In accordance with the invention, the frequency tuning element (42) for tuning the resonance frequency of the resonance circuit and the means (32) fastened to the resonator (18) for increasing the cross-sectional area of the resonator form an integral whole, being a projection projecting from the means (32) for increasing the cross-sectional area, the resonance frequency of the resonance circuit (12) being tuned by adjusting the distance of said projection with respect to the shell construction (2*a*).

20 Claims, 3 Drawing Sheets

FILTER AND TUNING ELEMENT

Figure 1:
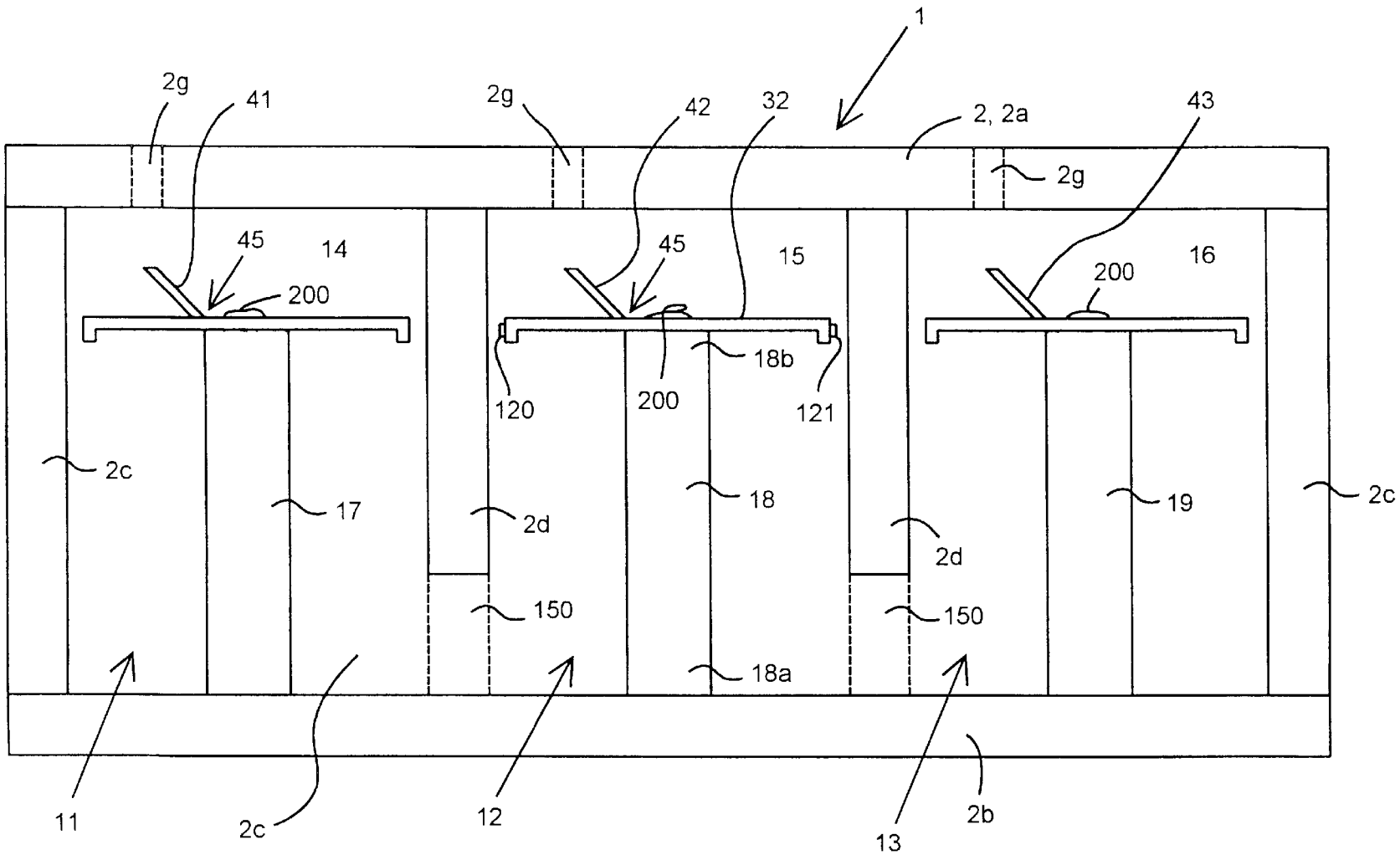

The invention relates to a filter comprising a shell construction of conductive material with at least one section and at least one resonator of conductive material in said at least one section for forming at least one resonance circuit, in which filter the resonator comprises as its extreme ends a base and a second end, the base being fastened to the shell construction and the second end being directed elsewhere towards the shell construction at a distance therefrom, the resonator comprising a means which directs its surface towards the shell construction and increases the cross-sectional area of the resonator to increase the capacitance between the resonator and the shell construction, the filter further comprising a frequency tuning element of conductive material for tuning the resonance frequency of the resonator of the resonance circuit.

The invention also relates to a tuning element, particularly a frequency tuning element, for tuning the resonance frequency of a resonance circuit formed by a filter section and a resonator disposed in the section.

Radio frequency filters, such as resonator filters, are used to implement high-frequency circuits in base stations of mobile telephone networks, for example. One way is to use radio frequency filters as interface circuits and filtering circuits in transmitters or receivers in base stations, for example.

Resonator filters comprising a shell construction, i.e. a body, are of various types including e.g. coaxial resonator filters and L-C filters. The present solution is particularly related to coaxial resonators. In addition, for instance a helix resonator and a cavity resonator are also known. All these resonator types comprise a metal shell construction. In coaxial resonators, for example, the shell construction envelops a conductor which is positioned in the middle of the cavity of the shell and is called a resonator or resonator rod. In helix resonators, the resonator wire is wound as a spiral coil. A cavity resonator only comprises a cavity.

As the size of devices comprising filters decreases, resonators also have to be made small. To reduce the space required by a resonator, a helix coil is used where the same operational length fits into a shorter space, since in a helix resonator the resonator is formed as a coil. However, helix coils are difficult to manufacture, a further drawback being the difficulty to fasten to a helix coil a coupling element or other such projection, needed to adjust the coupling between two resonance circuits. A further problem in helix resonators is the difficulty to support them and carry out temperature compensation. A conventional resonator is a quarter wave long.

In a coaxial resonator, the resonator is usually a straight rod which is fastened only to the bottom of the resonator. Such a resonator is long and consequently takes up much space. A U-shaped coaxial resonator type is also known, i.e. one that comprises a turning point. Such a construction allows a smaller size, but its manufacture is problematic particularly because the initial section of the resonator has to be fastened and the end section supported to different surfaces, which significantly complicates the manufacture and assembly of the filter. To be able to save space by employing shorter resonators when straight coaxial resonators are used, without, however, changing the frequency range, it is known to use at one end of the resonator, such as the free end or in the area thereof, a conductive plate having a large surface area as compared with the resonator rod. Said plate increases the cross-sectional area of the resonator, and the increased area causes the capacitance between one end of the resonator, such as the free end, and the shell construction to increase, and the frequency range shows a tendency to a lower frequency thus compensating for the tendency of the frequency range of a shorter resonator to a higher frequency. Accordingly, a quarter-wave electric length is achieved although the physical length is clearly shorter.

The element increasing the cross-sectional area of a resonator, such as a conductive plate, can be thought to operate as one electrode of the capacitance, the cover of the shell constituting the other electrode. The surface area of the element increasing the cross-sectional area of the resonator increases the capacitance.

The present invention is particularly applicable to a filter using a conductive plate or other such construction which increases the cross-sectional area of the resonator end.

The operative frequency, i.e. resonance frequency, of the resonance circuit formed by a resonator and a section is tuned to make the resonance circuit operate in the desired manner, whereby the resonance circuit alone, or in practice, however, the integral formed by several resonance circuits, implements a desired frequency response, which e.g. in a band-pass filter is the pass band, the signals inside of which the filter lets through. The pass band can be e.g. a 25-MHz frequency band, employed in TDMA-based base stations of the GSM system at the frequency range from 925 to 960 MHz, within which the 200-kHz single channels of the GSM system are located.

Tuning the resonance frequency of the resonance circuit of the filter is known to be achieved by changing the distance between the free end of the resonator and the grounded shell by means of a frequency tuning element. As the distance decreases, the capacitance between the free end of the resonator and the shell increases and the resonance frequency decreases, whereas, as the distance increases, the capacitance decreases and the resonance frequency increases.

A known solution for tuning the resonance frequency of a resonance circuit is a tuner bolt in the filter cover, the distance of which from the free end of the resonator in the section below the cover can be tuned by rotating the bolt. Said solution is not optimal, since it requires extra constructions on the outer surface of the shell. Another problem is that the tuner bolt requires a thick cover, or one which is thickened at least at some point to enable threads to be provided in the cover for the frequency tuner bolt, or, alternatively, a threaded nut-type part to be fastened to the cover. The cover has to be thick because it also has to be rigid for the distance of the frequency tuning element from the resonator not to change after tuning and cause the capacitance and, consequently, the resonance frequency, to change in an undesired manner.

In another known solution the resonance frequency is tuned by means of a bendable strip-like tuning projection. Said solution is also problematic because for the tuning to remain unchanged it also requires a thick cover, but an easily bendable tuning projection is difficult to implement in a thick cover.

It is an object of the present invention to provide a new kind of filter and frequency tuning element which eliminate the problems of known solutions.

This object is achieved by the filter of the invention, which is characterized by the frequency tuning element for tuning the resonance frequency of the resonance circuit and the means fastened to the resonator for increasing the cross-sectional area of the resonator forming an integral whole, the frequency tuning element being a projection projecting from the means for increasing the cross-sectional area, the resonance frequency of the resonance circuit being tuned by adjusting the distance of said projection to the shell construction.

The frequency tuning element of the invention, in turn, is characterized by forming, together with a means fastened to the resonator for increasing the cross-sectional area of the resonator, an integral whole and being a projection projecting from the means for increasing the cross-sectional area.

The solution of the invention provides several advantages. The invention enables a highly integrated integral construction in which the frequency tuning element is formed in the same piece which is used for forming the plate-like or other such means for increasing the cross-sectional area of the resonator. As to frequency tuning, the filter construction of the invention is easy and fast to make and assemble. To implement the frequency tuning element as defined by the invention simplifies the manufacture of the cover which forms part of the shell construction, since no threads or bending strips are needed in the cover, a hole made for a tuning tool being sufficient. The frequency tuning element of the invention can be easily made from e.g. a thin metal plate by etching a slot therein for defining the frequency tuning element. Compared with bolt tuning, a significant advantage is that the frequency tuning element does not take up space on the outer surface of the shell, whereby the filter fits into a smaller space because of the smaller outer dimensions of the shell.

Figure 2:
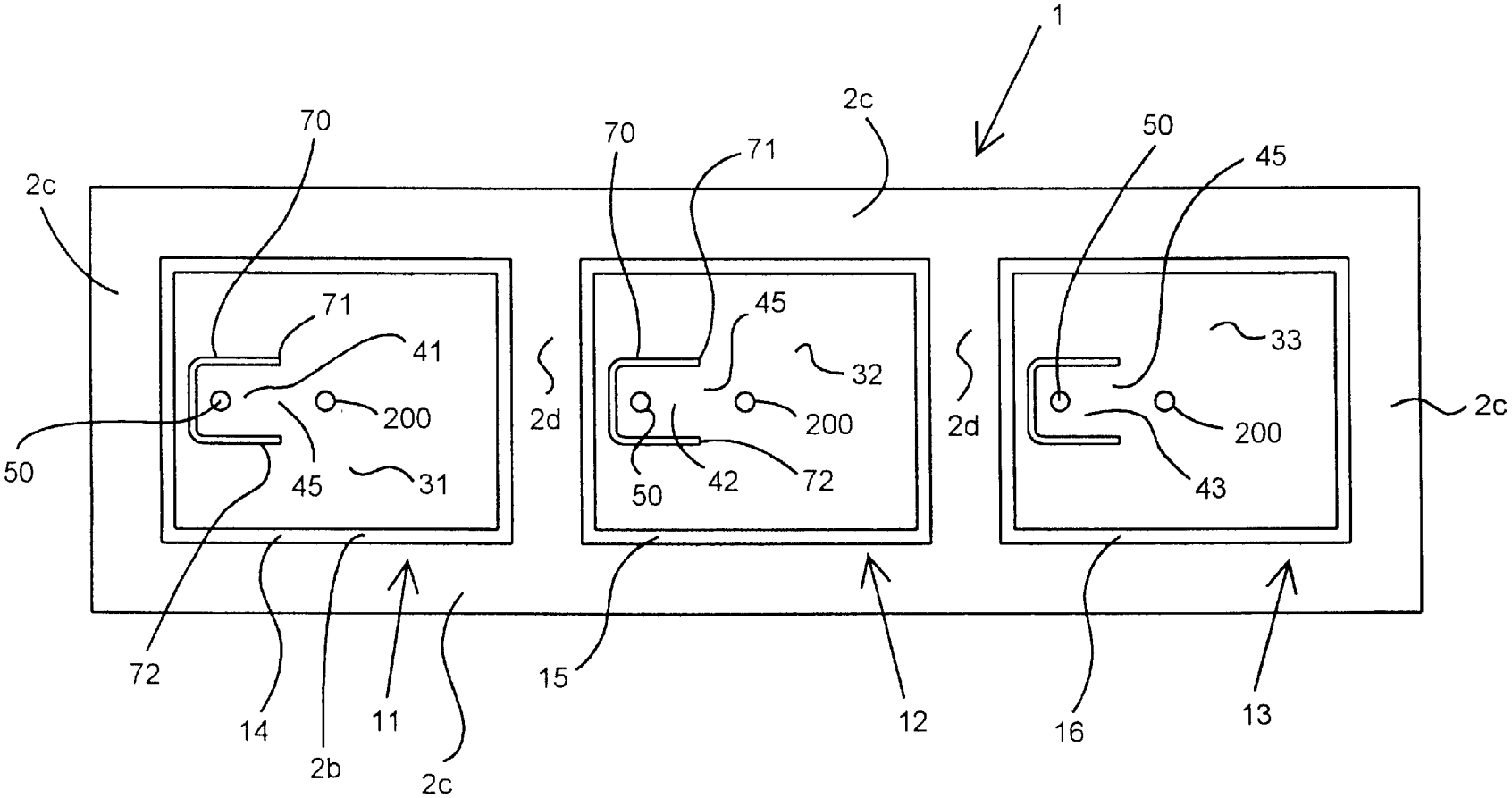
Figure 4:
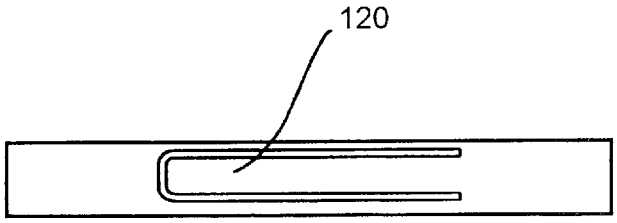
Figure 5:
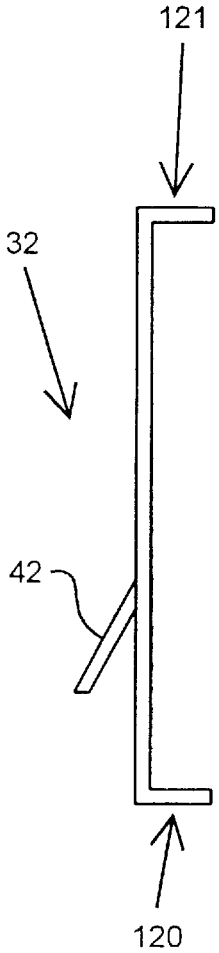
Figure 3:
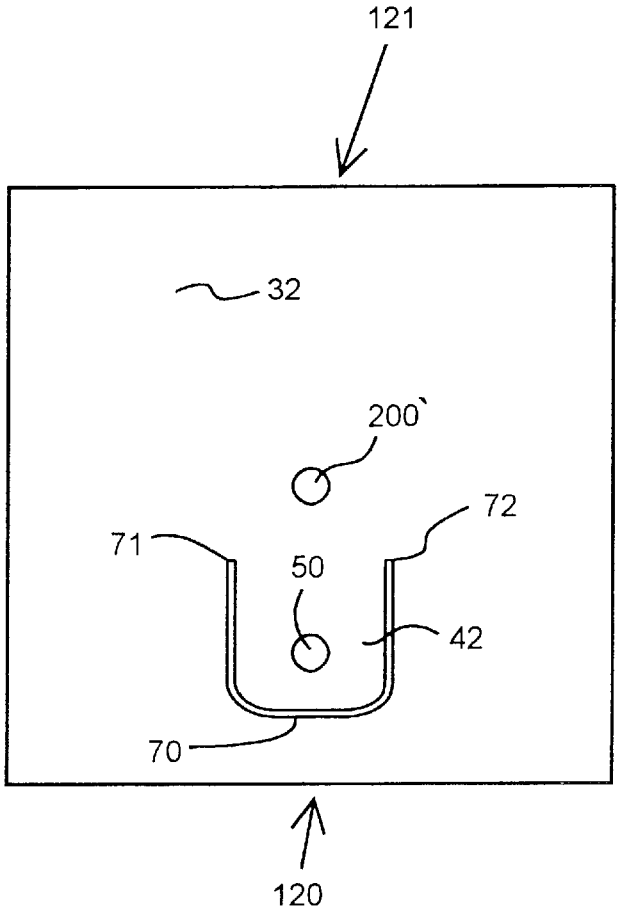

In the following the invention will be described in greater detail with reference to the attached drawings, in which FIG. 1 is a schematic side view of a 3-circuit filter with the resonance frequency tuning elements bent to a position after tuning, FIG. 2 is a schematic top view, seen from the direction of the cover, of the 3-circuit filter of FIG. 1 with the resonance frequency tuning elements bent to a position after tuning, FIG. 3 is a top view of the means for increasing the cross-sectional area of the resonator, with integrated resonance frequency tuning element and coupling adjusting elements between resonance circuits, FIG. 4 is a view from a first side of the means for increasing the cross-sectional area of the resonator, with integrated resonance frequency tuning element and coupling adjusting elements between resonance circuits, FIG. 5 is a view from a second side of the means for increasing the cross-sectional area of the resonator, with integrated resonance frequency tuning element and coupling adjusting elements between resonance circuits.

FIGS. 1 and 2 show a multi-circuit, e.g. 3-circuit, filter 1, particularly a radio frequency filter 1 for use in transceivers, such as base stations, of radio telephone systems, such as a cellular network radio. The filter comprises a shell 2 having a bottom 2*a*, a cover 2*b* and a wall construction 2*c*, 2*d* comprising side walls 2*c* and section walls 2*d*.

The shell 2, 2*a* to 2*d* of the filter 1 comprises several, in this case three, resonance circuits 11 to 13, each comprising a section 14, 15 and 16, respectively, and in each section a resonator 17, 18 and 19, respectively. The shell construction 2*a* to 2*d* defines the sections and their shape, which in this example is rectangular. Naturally, the shape can be different, such as round cylinder-like. Together the resonance circuits 11 to 13 of the filter 1 implement a desired frequency response, e.g. a pass band. It is obvious that the invention is independent of the number of resonance circuits in the filter.

The connection between the resonators 17 to 19 and the bottom 2*b* of the shell construction 2 can be e.g. a solder joint, screw joint, other joint, or the resonator can be integrated into a fixed part of the bottom 2*a*. The version in the drawings uses a solder joint or e.g. a screw joint.

Hereinafter the invention will be described mainly with reference to the middle resonance circuit 12 only, since the constructions are similar in the adjacent resonance circuits.

The invention thus relates to a filter 1 comprising a shell construction 2*a* to 2*d* of conductive material and comprising at least one section 15 and in the shell construction 2*a* to 2*d* at least one resonator 18 of conductive material in said at least one section 15 for generating at least one resonance circuit. As its extreme ends the resonator 18 comprises a base 18*a* and a second end 18*b*, most preferably a free end 18*b*, i.e. a non-shorted end. The resonator 18 base 18*a* refers to that resonator area from which it is fastened to the bottom 2*a* of its section 15, i.e. the bottom 2*b* of the shell construction, which represents ground potential, as does the rest of the shell construction 2*a*, 2*c*, 2*d*. The second end, such as the free end 18*b*, of the resonator 18, in turn, is directed towards the shell construction 2, i.e. more exactly most preferably towards the cover 2*a* of the shell construction 2, i.e. the cover 2*a* of the section, since a straight purely coaxial resonator rod is involved, with its ends pointing 180 degrees in opposite directions. The free end 18*b* of the resonator 18 is at a short distance from the cover 2*a*. The distance is preferably in the order of 2 to 10 mm. In spite of the expression free end, the second end 18*b* of the resonator may quite well be supported by some means to the cover 2*a* of the shell, provided the means is not electrically conductive.

Referring to FIGS. 1 and 2, as well as 3 to 5, the resonator 18, preferably its second end 18*b*, such as the free end 18*b*, or at least the area nearer the free end than the base 18*a* shorted to ground potential, i.e. the bottom 2*b* of the section, comprises a means 32 for increasing the cross-sectional area of the resonator, the means directing its surface towards the shell construction 2*a*, i.e. the cover 2*a*, for increasing the capacitance between the area on the side of the second end 18*a* of the resonator and the shell construction 2*a*. In a known manner, the means 32 for increasing the cross-sectional area of the resonator enables the use of a resonator which is shorter than a quarter wave, because an increase in the area of the means 32 for increasing the cross-sectional area, the area facing the cover 2*a* of the shell, increases the capacitance between the cover 2*a* of the shell and the area on the side of the free end 18*b* of the resonator 18. The increase in capacitance, in turn, reduces resonance frequency in accordance with a known formula, thus compensating for the increase in resonance frequency otherwise caused by the shorter resonator. A similar kind of means 31 for increasing the cross-sectional area of the resonator is also in the first resonator 17 and a similar means 33 in the third resonator 19 in FIGS. 1 and 2.

The filter 1 further comprises a frequency tuning element 42 of conductive material for tuning the resonance frequency of the resonance circuit 12. In accordance with the solution of the invention, said frequency tuning element 42 for tuning the resonance frequency of the resonance circuit 12 and the means 32 fastened to the resonator for increasing the cross-sectional area of the resonator form an integral whole, the frequency tuning element being a projection 42 projecting from the means 32 for increasing the cross-sectional area, the distance of which to the shell construction 2*a* is adjusted to tune the resonance frequency of the resonance circuit 12. The resonance frequency f is obtained by dividing the numerical value 1 by the square root of the resonator capacitance and inductance and by the numerical value 2 pi.

The frequency tuning elements in the resonators 17 and 19 are denoted by reference numbers 41 and 43.

The figures, particularly FIGS. 3 to 5, show that the frequency tuning element 42 is most preferably a planar projection which produces a sufficient surface area projection towards the second electrode, i.e. the cover 2*a*, improving tuning sensitivity. The frequency tuning element 42 is most preferably a straight planar projection, not arched, for example, since a straight planar surface 42 is easier to produce and to bend, and can be tuned more accurately, the effects of the tuning being more reliable. In a preferred embodiment of the invention the frequency tuning element 42, as well as the means 32 for increasing the cross-sectional area to which the tuning element 42 is formed, is of thin metal material having a strength of at most 2 mm. This is easy to make and its electric and mechanical properties are adequate, but it can still be bent. The applicant has found 0.6-mm sheet copper to be extremely preferable and suitable.

The shell, preferably the cover 2*a* of the shell, i.e. the section, comprises holes 2*g* for pushing to the shell a tool required for tuning the frequency tuning element 42.

FIGS. 3 to 5 show that in a preferable embodiment the frequency tuning element 42 comprises a hole, recess or other such space 50 or shape which acts as a bearing point for a tuning tool for tuning the frequency of the resonance circuit 12 by a movement directed to the tuning element 42. The tuning element can be e.g. a hook with a shaft, which is pushed into the space 50 in the frequency tuning element 42 in the resonator 18 in the section 15 of the resonance circuit. The hook-like tool is used to pull the frequency tuning projection 42 into such a position relative to the cover 2*a* that it on its part enables the formation of a desired filter frequency band.

In a preferred embodiment the filter is such that the frequency tuning element 42 comprises a joining base 45 for connecting the frequency tuning element 42 and the means 32 for increasing the cross-sectional area. This is most preferably implemented by a slot 70 arranged in the means 32 for increasing the cross-sectional area, between the resonance circuit frequency tuning element 42 and the means 32 for increasing the cross-sectional area, the slot defining the shape of the frequency tuning element 42, which in the example of the drawings is mainly rectangular, as is the means 32 for increasing the cross-sectional area. However, the shape of the frequency tuning element 42 can vary according to the need. The figures show that said most preferably plate-like means 32 for increasing the cross-sectional area of the resonator comprises slot ends 71, 72 as the extreme ends of the slot 70, and that the tuning element has a joining base 45 between the ends 71, 72 of the slot 70 in the means 32 for increasing the cross-sectional area.

In order for the bending of the frequency tuning element 42 with respect to its joining base 45 not to unfavourably twist the plate-like means 32 for increasing the cross-sectional area of the resonator 18, in a preferred embodiment the joining base 45 of the frequency tuning element 42 is disposed in the middle area or in the vicinity of the middle area of the means 32 for increasing the cross-sectional area. This ensures that when the frequency tuning projection 42 is pulled by a tuning tool, the torsion caused by the bending of the projection 42 is symmetrically distributed to the plate 32 for increasing the cross-sectional area, and does not twist the plate 32, i.e. the means 32 for increasing the cross-sectional area, to an eccentrically bent position.

Referring to FIGS. 1 and 2 in particular, but also to FIGS. 3 to 5, in a preferred embodiment the filter is of a multi-circuit type comprising a plurality of sections 14 to 16 and a plurality of resonators 17 to 19, which in pairs form a plurality of resonance circuits, between which the filter comprises in the resonator 18 coupling adjusting elements 120, 121 of conductive material for tuning the coupling between the adjacent resonance circuits 11 and 12, and 12 and 13. The solution is preferably such that the frequency tuning element 42 for tuning the frequency of the resonance circuit 12 is disposed in such a means 32 for increasing the cross-sectional area of the resonator which also comprises the coupling adjusting element 120 to 121. In this case the integration is in a way threefold, since the same plate comprises the means 32 for increasing the cross-sectional area, i.e. a plate or corresponding means, and, in addition to the frequency tuning element 42 for tuning the frequency of the resonance circuit 12, also the means 120 and 121 used for tuning the coupling between adjacent resonance circuits. In such an integrated construction, the coupling adjusting element 120 to 121 between the resonance circuits is, like the frequency tuning element 42, an integral whole of the means 32 for increasing the cross-sectional area of the resonator fastened to the free end, or at least to the side of the free end of the resonator, being a projection 120 to 121 projecting from the means 32 for increasing the cross-sectional area. Since the example of the figures only has three circuits, the coupling adjusting elements 120 to 121 are only required in the plate 32 of the middle resonance circuit 12, whose left edge comprises a coupling adjusting element 120 which acts on the coupling between the first resonance circuit 11 and the second resonance circuit 12. Similarly, the tuning element 121 at the right edge of the plate of the middle resonance circuit 12 acts on the coupling between the second resonance circuit 12 and the third resonance circuit 13.

In order for the frequency tuning and coupling adjusting comprised by an integrated plate-like or other such means 32 of the type described above not to interfere with each other, the invention is preferably such that the surface comprised by the frequency tuning element 42 and the surface comprised by the coupling adjusting element 120 extend in mutually transverse directions. Before the tuning element 42 and the adjusting element 120 are bent, the traverse is very exactly 90 degrees, and the strength of the traverse after the bending naturally depends on the angle to which the frequency tuning element 42 is bent and the angle to which the element 120 tuning the coupling between the resonance circuits is bent.

In addition to the filter, the invention also relates to a tuning element 42, specifically to a frequency tuning element 42 for tuning the resonance frequency of the resonance circuit 12 formed by the section 15 of the filter and the resonator 18 in the section. According to the invention, it is essential that the frequency tuning element 42 is an integral whole of the means 32 fastened to the resonator 18 or otherwise disposed in the resonator for increasing the cross-sectional area of the resonator 18, and extends as a projection 42 from the means 32 for increasing the cross-sectional area, as described above. As to the preferred embodiments of the frequency tuning elements 42, reference is made to the above-described preferred embodiments.

The above preferred embodiments and other detailed embodiments of the invention described above improve the operation of the invention and enhance the advantages of the basic invention.

In FIGS. 1 and 2, the coupling between the resonance circuits takes place via coupling holes 150 comprised by the section walls 2*d* between the sections.

In FIGS. 1 and 2, on top of the means 31 to 33 is visible a fastening 200, such as a solder joint, for fastening the plates 31 to 33 for increasing the cross-sectional area to the resonators 17 to 19. Before soldering, the means 31 to 33 comprised holes 200 in the manner shown in FIG. 3. In stead of a solder, e.g. a screw can be used.

Even though the invention has been described above with reference to the examples in the attached drawings, it is to be understood that the invention is not restricted thereto, but can be modified in a variety of ways within the inventive idea disclosed in the claims.

What is claimed is:

1. A filter comprising:

a shell construction of conductive material with at least one section;

at least one resonator of conductive material in the at least one section for forming at least one resonance circuit, the resonator comprising at opposite ends a base and a second end, the base being fastened to the shell construction and the second end being directed elsewhere towards the shell construction at a distance therefrom, and means on the resonator having a surface directed towards the shell construction and increasing the cross-sectional area of the resonator to increase the capacitance between the resonator and the shell construction; and a frequency tuning element of conductive material for tuning the resonance frequency of the resonance circuit, wherein the frequency tuning element and the means form an integral whole, the frequency tuning element being a projection from the means, whereby the resonance frequency of the resonance circuit is tuned by adjusting a distance of the projection from the shell construction.

2. A filter as claimed in claim 1, wherein the frequency tuning element is a planar projection.

3. A filter as claimed in claim 1, wherein the frequency tuning element is a straight planar projection.

4. A filter as claimed in claim 1, wherein the frequency tuning element and the means for increasing the cross-sectional area, to which the tuning element is formed, are of thin metal material having a strength of at most 2 mm.

5. A filter as claimed in claim 1, wherein the frequency tuning element comprises a hole, recess or other such space or shape, acting as a support point for a tuning tool with which the frequency of the resonance circuit can be tuned by a movement directed to the tuning element.

6. A filter as claimed in claim 1, wherein the frequency tuning element comprises a joining base for connecting the frequency tuning element and the means for increasing the cross-sectional area.

7. A filter as claimed in claim 1, wherein between the frequency tuning element for the resonance circuit, formed in the means for increasing the cross-sectional area, and the means for increasing the cross-sectional area, the means for increasing the cross-sectional area comprises a slot for defining the shape of the frequency tuning element.

8. A filter as claimed in claim 6, wherein between the frequency tuning element for the resonance circuit, formed in the means for increasing the cross-sectional area, and the means for increasing the cross-sectional area, the means for increasing the cross-sectional area comprises a slot and, as the extreme ends of the slot, slot ends, and that the joining base of the tuning element is disposed between the ends of the slot in the means for increasing the cross-sectional area.

9. A filter as claimed in claim 6, wherein the joining base of the frequency tuning element is in the middle or in the vicinity of the middle area of the means for increasing the cross-sectional area.

10. A filter as claimed in claim 1, wherein the filter is a multi-circuit filter comprising a plurality of sections and a plurality of resonators, which in pairs form a plurality of resonance circuits, between which the filter comprises in the resonator a coupling adjusting element of conductive material for tuning the coupling between the adjacent resonance circuits, and that the frequency tuning element for tuning the frequency of the resonance circuit is positioned in such a means for increasing the cross-sectional area of the resonator which also comprises the coupling adjusting element.

11. A filter as claimed in claim 10, wherein, in the same way as the frequency tuning element, the coupling adjusting element between the resonance circuits is of an integral whole of the means fastened to the resonator for increasing the cross-sectional area, being a projection projecting from the means for increasing the cross-sectional area.

12. A filter as claimed in claim 10, wherein the surface comprised by the frequency tuning element and the surface comprised by the coupling adjusting element extend in mutually transverse directions.

13. A tuning element, particularly a frequency tuning element, for tuning the resonance frequency of a resonance circuit formed by a filter section and a resonator disposed in the section, wherein the frequency tuning element and a means fastened to the resonator for increasing the cross-sectional area of the resonator, form an integral whole, the frequency tuning element being a projection projecting from the means for increasing the cross-sectional area.

14. A filter as claimed in claim 11, wherein the surface comprised by the frequency tuning element and the surface comprised by the coupling adjusting element extend in mutually transverse directions.

15. A filter as claimed in claim 13, wherein the frequency tuning element is a planar projection.

16. A filter as claimed in claim 13, wherein the frequency tuning element is a straight planar projection.

17. A filter as claimed in claim 13, wherein the frequency tuning element and the means for increasing the cross-sectional area, to which the tuning element is formed, are of thin metal material having a strength of at most 23 mm.

18. A filter as claimed in claim 13, wherein the frequency tuning element comprises a hole, recess or other such space or shape, acting as a support point for a tuning tool with which the frequency of the resonance circuit can be tuned by a movement directed to the tuning element.

19. A filter as claimed in claim 13, wherein the frequency tuning element comprises a joining base for connecting the frequency tuning element and the means for increasing the cross-sectional area.

20. A filter as claimed in claim 13, wherein between the frequency tuning element for the resonance circuit, formed in the means for increasing the cross-sectional area, and the means for increasing the cross-sectional area, the means for increasing the cross-sectional area comprises a slot for defining the shape of the frequency tuning element.

* * * * *